United States Patent [19]

Bard

[11] Patent Number: 4,896,388

[45] **Date of Patent: * Jan. 30, 1990**

[54] WATER PILLOW

[76] Inventor: Maurice R. Bard, 38 Hirondelle Place, Don Mills, Ontario, Canada, M3A 1V8

[ * ] Notice: The portion of the term of this patent subsequent to Jul. 18, 2006 has been disclaimed.

[21] Appl. No.: 251,240

[22] Filed: Sep. 30, 1988

Related U.S. Application Data

[63] Continuation-in-part of Ser. No. 192,783, May 10, 1988, Pat. No. 4,847,931.

[51] Int. Cl.[4] ..... A47G 9/00

[52] U.S. Cl. ..... 5/441; 5/442

[58] Field of Search ..... 5/441, 451, 452, 422, 5/434, 436, 442, 490; 297/DIG. 3

[56] References Cited

U.S. PATENT DOCUMENTS

| | | | |
|---|---|---|---|
| 2,521,530 | 9/1950 | McGuffage | 5/441 |
| 3,411,164 | 11/1968 | Sumergrade | 5/441 |
| 4,187,569 | 2/1980 | Calleance | 5/452 |
| 4,467,484 | 8/1984 | Nagatake et al. | 5/441 |
| 4,660,238 | 4/1987 | Jay | 5/451 |

*Primary Examiner*—Alexander Grosz

[57] ABSTRACT

A pillow casing according to the present invention comprises a top surface and a connected bottom surface which cooperate to define an enclosure for receiving a compressible filler therein. The pillow casing further includes a thin envelope layer intermediate the surfaces and attached to the bottom surface. The envelope layer is adapted to sealably receive a fluid-like material therein to form a thin fluid-like layer remote and isolated from the top surface when the compressible filler is received in the enclosure. The filler, when received in the enclosure, is supported by the envelope layer to effectively float the received compressible filler on the fluid-like material received in the envelope. The pillow casing is particularly adapted for receiving a conventional pillow as the compressible filler material therein. Thus, the pillow casing can cooperate with a conventional pillow to substantially alter the pillow characteristics of the combination by floating the pillow on a thin layer of fluid. The invention is also directed to a complete pillow, in which case a compressible filler material is inserted into the pillow casing at the time of manufacture.

41 Claims, 4 Drawing Sheets

WATER PILLOW

This application is a continuation-in-part of my earlier application Ser. No. 192,783 filed May 10, 1988 now U.S. Pat. No. 4847931.

FIELD OF THE INVENTION

The present invention relates to improvements in pillows and in particular, relates to an improved pillow casing which can cooperate with a conventional pillow to substantially alter the characteristics of the combined pillow casing and pillow. In a preferred form, the invention relates to the floating of a conventional pillow or the like on a thin fluid-like layer located beneath the pillow or the like.

BACKGROUND OF THE INVENTION

Conventional pillows are well known and essentially rely on a compressible fill material such as feathers, foam, foam chips, or the like, to provide a comfortable surface to allow a person to rest their head thereon. In recent times, it has been found in bed design that a water filled mattress is desirable and many arrangement have been proposed with respect to a displaceable fluid associated with a bed mattress. Other arrangements are also known which combine a fluid-like chamber with a compressible foam cover, however, these arrangements do not realize the significance and the substantial changes possible by floating of a conventional pillow on a thin layer of displaceable fluid.

SUMMARY OF THE INVENTION

A pillow casing according to the present invention comprises a first surface and a connected second surface with the surfaces cooperating to define an enclosure for receiving a compressible filler therein. The pillow casing includes a thin envelope layer intermediate the surfaces and attached to the second surface. The envelope layer is adapted to sealably receive a fluid-like material therein to form a thin fluid-like layer remote and isolated from the first surface when the compressible filler is received in the enclosure. The filler, when received in the enclosure, is centrally supported by the envelope layer to effectively float the received compressible filler on the fluid-like material received in the envelope.

The invention is also directed to the combination of a conventional headrest pillow for a bed and a water pillow casing. The headrest pillow has a fabric casing and a compressible filler material within the casing. The water pillow casing comprises a fabric outer shell having distinguishable top and bottom surfaces. The bottom surface includes a plastic fluid retaining envelope attached essentially immediately above the bottom surface for forming a thin layer capable of receiving a fluid for supporting the compressible filler material of the headrest pillow. The headrest pillow is received within the water pillow casing intermediate the plastic fluid retaining envelope and the top surface of the fabric outer shell. In this way, the pillow can be effectively floated on top of the plastic fluid retaining envelope when a suitable fluid is retained by the envelope. Such a pillow has basically a combination of the normal characteristics of a pillow and improvements due to the diplaceable nature of the fluid within the plastic retaining envelope. This arrangement provides a convenient means for a user to combine the desirable characteristics of his own pillow with a water pillow casing which will not only have the desirable characteristics, but further improvements due to the displaceable nature of the fluid retained within the plastic fluid retaining envelope.

BRIEF DESCRIPTION OF THE DRAWINGS

Preferred embodiments of the invention are shown in the drawings, wherein.

DETAILED DESCRIPTION OF THE PREFERRED EMBODIMENTS

Figure 2:
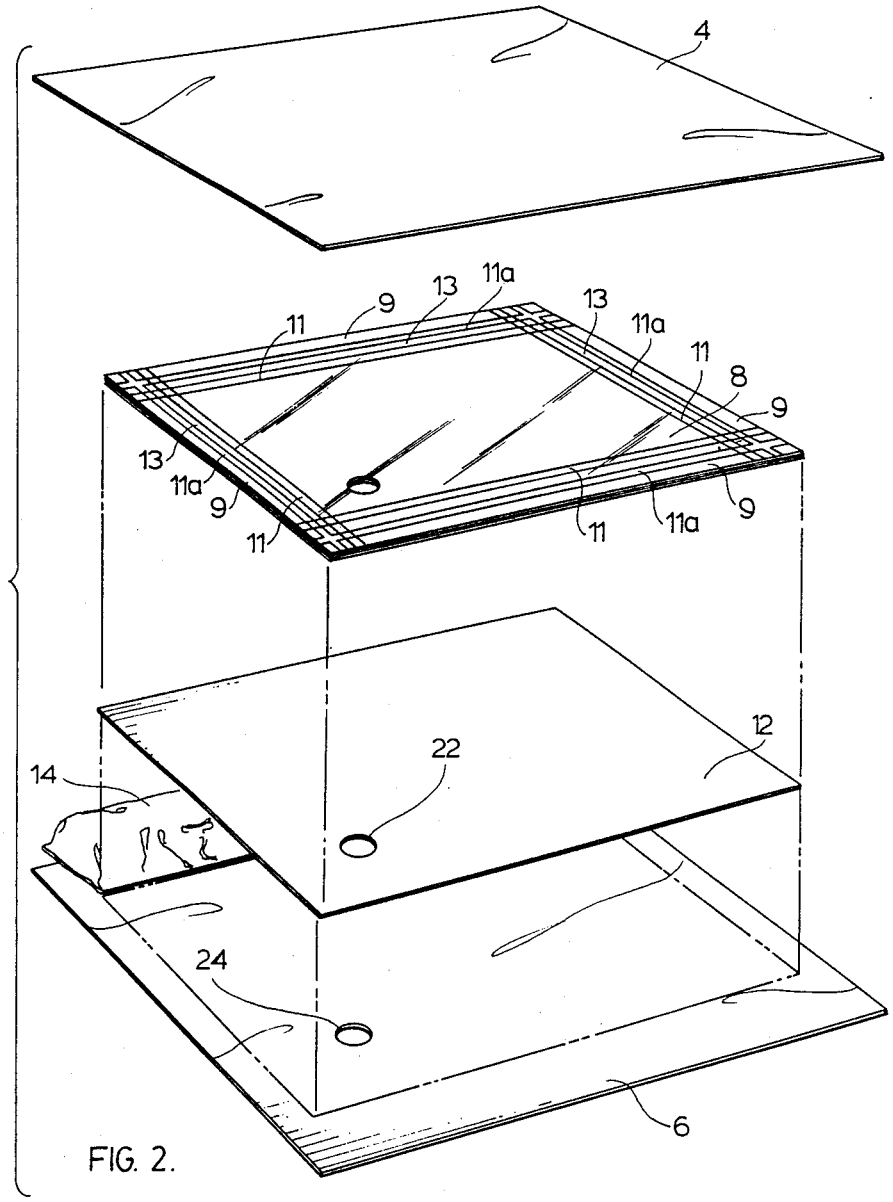
FIG. 2 is an exploded perspective view of the pillow casing.

The water pillow casing 2 includes a top or first surface 4 and a bottom or second surface 6 which cooperate and collectively define a pillow slip type arrangment for receiving a conventional pillow or other suitable compressible fill material. Within the water pillow casing 2 is a thin plastic fluid retaining envelope 8 which is attached by means of the fastening periphery 9 to the bottom surface 6 via the stitches 10 which pierce through the fastening periphery and pierce through the bottom surface 6. The fastening periphery 9 is located exterior to the heat seal 11 generally shown in FIG. 2. Within the fastening periphery 9 is a second heat seal 11*a* separated from interior heat seal 11 by a gap 13. The second heat seal 11*a* serves to maintain 4 ply configuration of film in a flat form for securement to the bottom surface 6. In the case of sewing of the envelope 8 to bottom surface 6, attachment can occur in the gap 13 or anywhere beyond heat seal 11. In some cases, a wide heat seal 11 is possible and securement can occur directly on the heat seal spaced from the interior edge. In this case, there may be no need for heat seal 11*a*. Intermediate the thin plastic fluid retaining envelope 8 and the bottom surface 6 is a thermal reflecting material 12 which is also attached to the bottom surface by means of the stitches 10. Thus, the plastic fluid retaining envelope 8 and the thermal reflecting material 12 are tied to the bottom surface 6.

Across the front of the water pillow casing 2 is a gusset 14 having a compressible fill material 16 inserted therein. This compressible fill material forms a neck roll at the front of the pillow and will protect the neck of the user or other body parts of the user from directly contacting the fluid retaining envelope 8 merely by placing their head on the pillow. Thus, the neck roll serves to isolate the front of the pillow from the plastic fluid retaining envelope. The plastic fluid retaining envelope 8 is generally centered relative to the bottom surface 6 and is of reduced size to define a border area of the bottom surface of about two inches. This border area reduces the likelihood of the user coming into close contact with the envelope, as the compressible filler material acts as a buffer and insulator as it overhangs the envelope about the sides thereof.

A similar gusset and compressible filler is provided at the opposite pillow edge. Gusset 15 and compressible filler 17 serve to level the support surface for pillow 18. It is desirable to have the fluid retaining envelope 8 separated from the edge of the overall pillow to avoid direct contact with the user and to reduce the size of the envelope 8. When in use, compressible fill 16 and 17 will act as a border and maintain the bottom surface of the conventional pillow 18 generally above the envelope 8.

The envelope when horizontally supported by the bottom surface is sized to receive fluid at a depth of ½ of an inch to 1½ inches. The compressible filler preferably is of a depth 3 to 4 times the depth of the fluid in the horizontal position. The actual envelope is preferably about 20 inches by 13 inches with a securement edge thereabout. A border beyond the envelope of about two inches is desired which provides pillow support.

Figure 1:
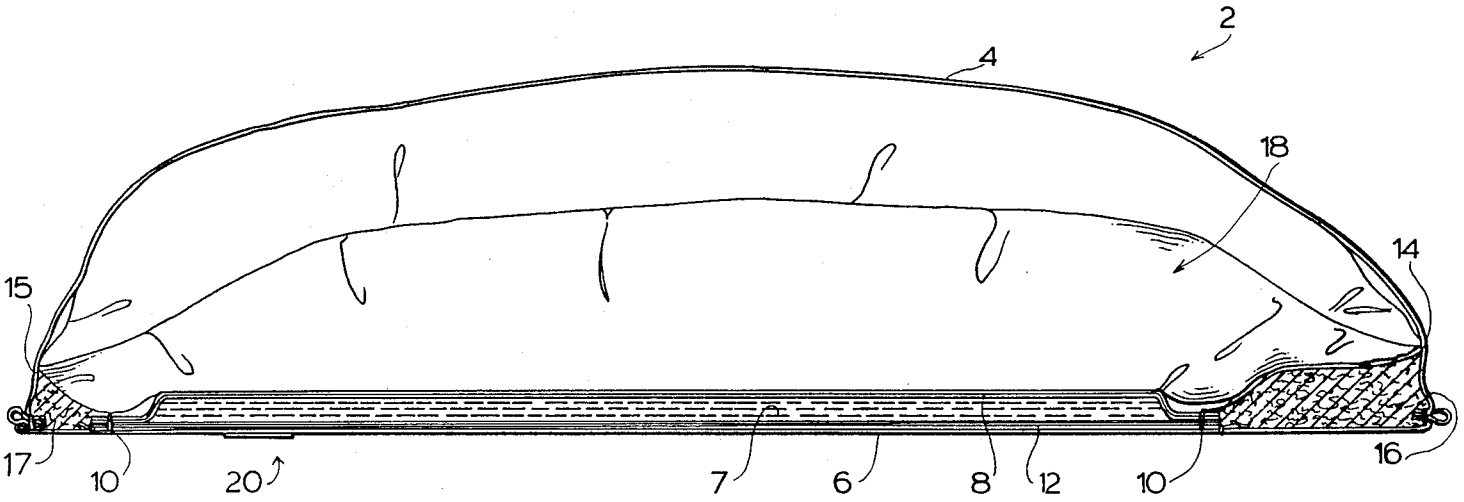
FIG. 1 is a partial sectional view of the pillow casing showing a conventional pillow therein.

A conventional pillow 18 has been inserted within the water pillow casing 2 and, as evidenced in FIG. 1, this conventional pillow has a large portion of the bottom surface thereof supported atop the fluid retaining envelope 8. The fluid 7 within the envelope is displaceable therein and as such, changes in the position of the head of the user will cause a sympathetic movement of the fluid 7 and surprisingly, the effect of this fluid retaining envelope 8 is to provide a pillow having many of the characteristics of a waterbed, while still having the inherent characteristics of the conventional pillow 18.

A spout 20 is provided in the thin plastic fluid retaining envelope 8 to allow the fluid to enter or be removed from the envelope. In the preferred embodiment shown, the thermal reflector 12 includes a cutout 22 and the bottom surface 6 has an aligned cutout 24 with these cutouts allowing a portion of the spout to pass therethrough and be exposed at the bottom of the bottom surface of the pillow. In this way, convenient access to the fluid retaining envelope 8 is achieved.

Figure 4:
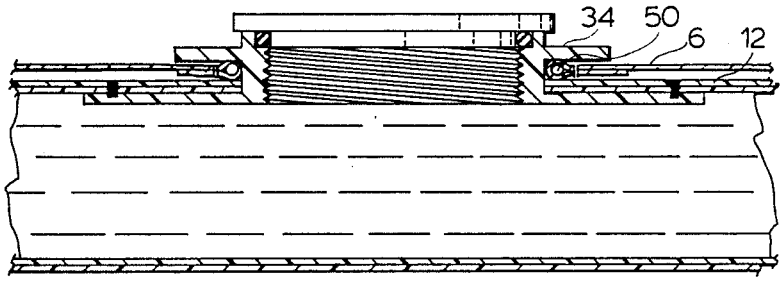
FIG. 4 is a partial sectional view showing securement of the spout in the bottom surface of the pillow casing and the sealing of the spout by means of a threaded plug.

Turning to FIG. 4, it can be appreciated that the fluid retaining envelope 8 includes a double ply thickness of a polyethylene film with this film being secured to the polypropylene spout 20 by heat sealing thereto on the large flange 32. This large flange is placed interior to the envelope and the double ply of film 28 and 30 is heat sealed to the flange at an exposed region. The spout 20 also includes a overlapping collar 34 with a 'U' shaped gap being defined by the collar 34, the lower flange 32 and the interior portion of the spout 20. This 'U' shaped recess serves to retain a portion of the bottom surface 6 and the thermal reflecting material 12 about their respective cutouts 22 and 24. The bottom surface 6 adjacent the cutout 24 includes an elastized portion 50 which serves to draw the periphery of the bottom surface about the cutout 22 into the recess defined between the collar 34 and the large flange 32. This arrangement provides a simple means of maintaining the thermal reflecting material 12 and the bottom surface 6 of the water pillow casing 2 about the spout.

Figure 3:
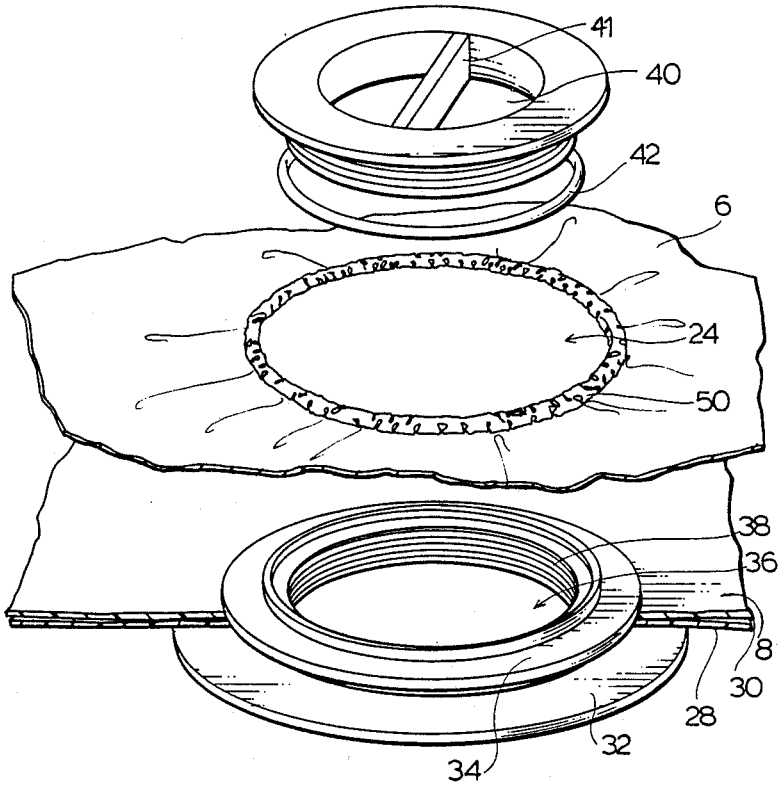
FIG. 3 is a partial perspective view showing the fill spout of the plastic fluid retaining envelope and the cooperation of this fill spout with the bottom surface of the pillow casing.

The spout is generally shown in FIG. 3 and includes an O-ring 42 which is received within the spout 20 and is compressed by the recessed threaded plug 40. This plug is threaded into the spout and serves to compress the O-ring 42 against a shoulder of the spout. This provides an effective seal and in addition, the external threads of the plug cooperate with the internal threads of the spout to provide additional seals such that there are several seals to minimize the possibility of leakage of the fluid material 7 out of the spout 20.

Although the spout is preferably provided at the bottom surface 6 of the water pillow casing 2, it can be provided interior to the water pillow casing 6 whereby access is gained from one end of the water pillow casing and the spout is provided on the top surface of the thin plastic fluid retaining envelope 8. In this embodiment, there is no need for cutouts in the bottom surface 6 or in the thermal reflector 8, and the assembly of the water pillow casing 2 is simplified. The bottom location of the water spout 20 is preferred as the spout is further isolated from the top surface of the water pillow casing 2 and is less likely to be felt by the user. However, it can be appreciated that depending upon the fill quantity of the conventional pillow, this may not be a problem and any problems can be reduced by positioning of the spout adjacent one end of the pillow. Therefore, the positioning of the spout can vary and in some cases, it may be preferred to provide it interior to the water pillow casing 2.

As shown in FIG. 3, the threaded recessed plug 40 includes an interior recess having a bar portion 41 extending thereacross. This bar portion divides the interior recess into two sections and a user can use the divided recess for tightening or loosening of the threaded plug from the spout 20.

Figure 5:
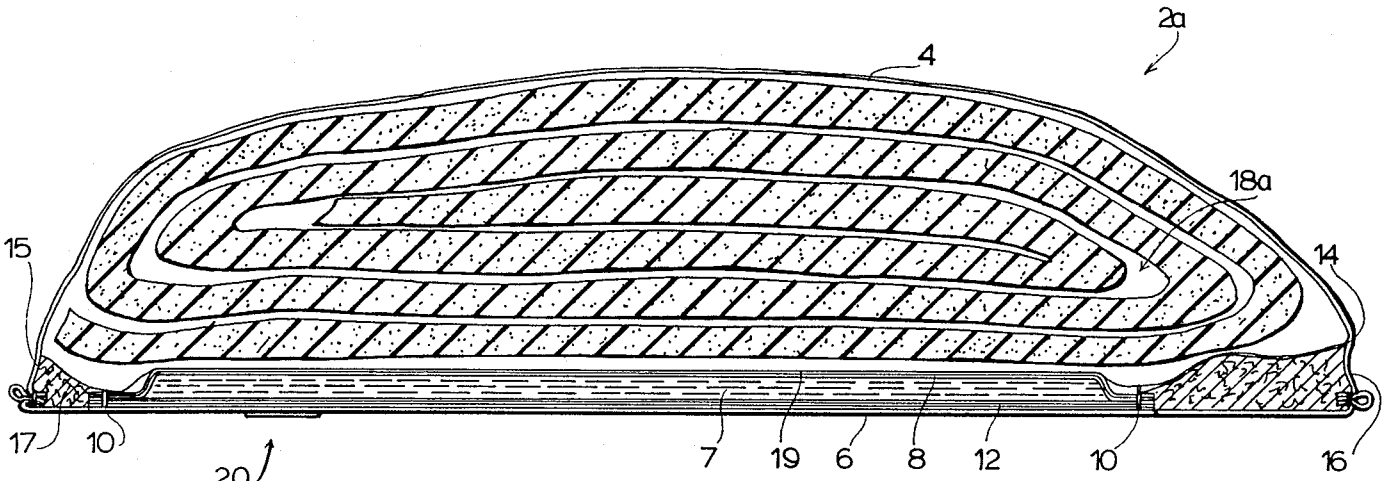
FIG. 5 is a sectional view of a modified pillow.

The pillow of FIG. 5 has been modified to accommodate the rolled batt of compressible filler material 18*a*. The modification includes a cover sheet 19 to separate the batt of compressible filler material 18*a* from the top plastic surface of the envelope 8. Cover sheet 19 reduces slippage of the batt along the envelope and, in combination with filled gussets 14 and 15, maintains the batt above the envelope 8 and generally intact. Without the filled gussets 14 and 15, the batt of compressible filler 19 would be pressed into the voids either side of the envelope 8 and thereby decrease the effectiveness of the batt. Premature wear, deformation and a decrease in effectiveness of the batt can occur if the batt is in direct contact with the envelope 8 and/or is forced to fill spaces where gussets 14 and 15 are located. It appears that the movement of fluid within the envelope tends to compact the rolled batt if allowed to enter the areas limited by gussets 14 and 15.

No specific arrangement for closing of the casing is shown, however, any suitable means can be used such as a zipper at one end, or a hook and loop type fastener, such as the one sold under the trademark of VELCRO or other type of closure. Thus, the pillow casing has one end which is open to allow a conventional pillow to be placed therein and thereafter the end may be closed.

Although various preferred embodiments of the present invention have been described herein in detail, it will be appreciated by those skilled in the art, that variation may be made thereto without departing from the spirit of the invention or the scope of the appended claims.

The embodiments of the invention in which an exclusive property or privilege is claimed are defined as follows:

1. A pillow casing comprising a first surface and a connected second surface which cooperate to define an enclosure for receiving a compressible filler therein, said pillow casing further including a thin envelope layer intermediate said surfaces and attached to said second surface at sufficient points such that the envelope is secured to and essentially immediately above the second surface to maintain said envelope layer and said second surface in overlapping relationship, said envelope layer being adapted to sealably receive a fluid-like material therein to form a thin fluid-like layer remote and isolated from said first surface when said compressible filler is received in said enclosure, said filler when received in said enclosure being supoorted by said envelope layer to effectively float such received compressible filler on such fluid-like material received in said envelope.

2. A pillow casing as claimed in claim 1, wherein said envelope layer includes a peripheral securement region thereabout which is physically attached to said second surface to maintain the envelope in position above said second surface.

3. A pillow casing as claimed in claim 2, including a thermal reflective layer intermediate said envelope and said second surface to limit heat transfer therebetween.

4. A pillow casing as claimed in claim 3, wherein said thermal reflective layer and said envelope are each attached by the same means to said second surface.

5. A pillow casing as claimed in claim 3, including pockets at a front edge and rear edge of the pillow casing running the length of said envelope and filled with a compressible fill material and extending above said envelope to define a raised border either side of said envelope, said raised border and said envelope cooperating to support said compressible filler.

6. A pillow casing as claimed in claim 5, including a cloth type fabric covering sheet intermediate said envelope and said compressible filler.

7. A pillow casing as claimed in claim 2, including a resealable spout in said envelope through which the fluid material enters said envelope or is removed therefrom, said resealable spout being of a polyethylene material.

8. A pillow casing as claimed in claim 7, wherein said resealable spout passes through an aligned hole in said second surface and includes an outer collar and an interior flange, said second surface about said aligned hole including an elastic border region for maintaining said border region intermediate said collar and said flange and about said spout.

9. A pillow casing as claimed in claim 8, wherein said spout includes a plug threadably received in said spout with said plug including an exteriorly exposed recess which is interiorly divided to allow the user to grip and rotate the plug.

10. A pillow casing as claimed in claim 8, wherein said envelope is of a double ply thickness.

11. A pillow casing as claimed in claim 10, wherein said enclosure is of a size to receive at least a three inch depth of compressible fill material above said envelope, and said envelope is sized in a flat orientation to retain a dephth of a fluid of about ½ of an inch to 1 inch.

12. In combination, a conventional headrest pillow for a bed and a water pillow casing, said headrest pillow having a fabric casing and a compressible filler material within said casing, said water pillow casing comprising a fabric outer shell having distinguishable top and bottom surfaces, said bottom surface including a plastic fluid retaining envelope attached thereto essentially immediately above said bottom surface for forming a thin layer of fluid for supporting the compressible filler material of said headrest pillow, said headrest pillow being received within said water pillow casing intermediate said plastic fluid retaining envelope and the top surface of said fabric outer shell.

13. In combination as claimed in claimed 12, wherein the uncompressed depth of said compressible filler material is at least three times greater than the depth of fluid in said fluid retaining envelope when supported by said bottom surface on a flat surface.

14. In combination as claimed in claim 12, wherein said plastic fluid retaining envelope includes an outer border area which is physically attached to said bottom surface to maintain the envelope generally overlapping with said bottom surface.

15. In combination as claimed in claim 12, including a suitable thermal reflecting material intermediate said fluid retaining envelope and said bottom surface and of a size to separate said envelope from said bottom surface.

16. In combination as claimed in claim 12, wherein said plastic fluid retaining envelope includes an outer border area which is physically attached to said bottom surface to maintain the envelope generally overlapping with said bottom surface and including a suitable thermal reflecting material intermediate said fluid retaining envelope and said bottom surface and of a size to separate said envelope from said bottom surface.

17. In combination as claimed in claim 16, wherein said plastic envelope is of a double ply thickness of plastic film such that two thicknesses of plastic film oppose leakage of fluid from said envelope.

18. In combination as claimed in claim 17, wherein said envelope includes an accessible resealable spout through which a fluid can be introduced into said envelope.

19. In combination as claimed in claim 18, including a fabric-like thermal reflecting material intermediate said bottom surface and said envelope covering the bottom surface of the envelope, said fabric like thermal reflecting material and said bottom surface of said water pillow casing include aligned holes through which a portion of said resealable spout extends, said spout including an outer collar portion and a cooperating flange which receive and retain a portion of said thermal reflecting material and said bottom surface about the aligned holes intermediate said outer collar portion and said cooperating flange.

20. In combination as claimed in claim 18, wherein said resealable spout is of a polyethylene material.

21. In combination as claimed in claim 20, wherein said bottom surface about said aligned hole includes an elastic stitching for retaining the same in snug engagement about said spout intermediate said collar and said flange.

22. In combination as claimed in claim 21, wherein said resealable spout includes a threaded plug by means of which the spout is opened and closed.

23. A pillow casing comprising a top surface and a connected bottom surface which cooperate to define an unobstructed enclosure running the length of the pillow casing for receiving a compressible filler therein, said pillow casing further including an envelope layer intermediate said surfaces and attached to said bottom surface, said envelope layer being sized and of a material to sealably receive a fluid-like material therein to form a fluid-like layer of a depth of about ½ to 1½ inches when supported horizontally on said bottom surface, said enclosure being sized to snuggly receive a conventional bed pillow therewithin between said envelope and said top surface.

24. A pillow casing as claimed in claim 23, wherein said envelope layer includes a peripheral securement region thereabout which is physically attached to said bottom surface to maintain the envelope in position above said bottom surface.

25. A pillow casing as claimed in claim 24, including a thermal reflective layer intermediate said envelope and said bottom surface to limit heat transfer therebetween.

26. A pillow casing as claimed in claim 25, wherein said thermal reflective layer and said envelope are each attached by the same means to said bottom surface.

27. A pillow casing as claimed in claim 24, including a resealable spout in said envelope through which the fluid material enters said envelope or is removed therefrom, said resealable spout being of a polyethylene material.

28. A pillow casing as claimed in claim 23, wherein the envelope layer is of reduced size relative to said bottom surface and is generally centered on said bottom surface to define a border of the bottom surface of about two inches.

29. A nonsymmetrical pillow comprising:

an outer casing, an envelope for receiving a fluid medium, said envelope covering and attached interiorly and essentially immediately adjacent to a major surface of said outer casing, a gusset member attached to the pillow casing to define a front pocket adjacent a front edge of the pillow and extending generally in the length thereof, a compressible filler within said front pocket which isolates said envelope from said front edge, and a compressible filler material within said outer casing such that a major portion of the compressible filler is supported above and by said envelope when said envelope is supported from below.

30. A nonsymmetrical pillow as claimed in claim 29, including a second gusset adjacent a rear edge of said pillow and extending in the length of said pillow defining a rear pocket adjacent the rear edge of the pillow and a compressible filler therein which provides a rear edge support for said envelope and extends substantially above said envelope.

31. A nonsymmetrical pillow as claimed in claim 30, including a fabric sheet attached to said envelope and said outer casing which separates said compressible filler material above said envelope from said envelope.

32. A nonsymmetrical pillow as claimed in claim 31, wherein said gussets and said fabric sheet fully separate said envelope from said compressible filler material and maintain said compressible filler material above said envelope.

33. A nonsymmetrical pillow as claimed in claim 32, wherein said compressible filler material is a rolled batt of compressible filler material.

34. A nonsymmetrical pillow as claimed in claim 30, wherein said envelope has a border of said casing of at least two inches thereabout which forms part of the pillow support surface.

35. A nonsymmetrical pillow as claimed in claim 34, wherein said envelope is about 20 inches by 13 inches.

36. A nonsymmetrical pillow as claimed in claim 30, wherein said envelope includes a fastening periphery thereabout which is secured to said outer casing by stitching.

37. A nonsymmetrical pillow as claimed in claim 36, wherein said envelope and a portion of each gusset are secured to said outer casing by the stitching securing said envelope to said outer casing.

38. A pillow casing comprising a first outer surface and a connected second outer surface which cooperate to define an enclosure for receiving a compressible filler therein, said pillow casing including a thin envelope layer for receiving and retaining a fluid-like medium intermediate said surfaces with said envelope layer being positioned adjacent to said second surface and attached thereto at sufficient points such that the envelope layer is tied to the second surface to maintain said envelope layer and said second surface in overlapping relationship, said enclosure above the envelope being open and of a size to receive a depth of several inches of compressible filler above said envelope to thereby position said envelope layer below a central plane running between said surfaces.

39. A pillow casing as claimed in claim 38, wherein said enclosure defines a single compartment extending the length of the pillow casing.

40. A pillow casing as claimed in claim 38, wherein said envelope includes a resealable spout passing through an aligned hole in said second surface, said resealable spout having an outer collar and an interior flange, said second surface adjacent said spout being trapped between said outer collar and said interior flange.

41. A pillow casing as claimed in claim 40, wherein said second surface about the aligned hole includes an elastic border region snuggly engaging said spout between said outer collar and said interior flange.

* * * * *